US006371596B1

(12) United States Patent
Maze et al.

(10) Patent No.: US 6,371,596 B1
(45) Date of Patent: Apr. 16, 2002

(54) ASYMMETRIC INK EMITTING ORIFICES FOR IMPROVED INKJET DROP FORMATION

(75) Inventors: Robert C. Maze; Timothy L Weber; Arun K Agarwal, all of Corvallis, OR (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/386,580

(22) Filed: Aug. 30, 1999

Related U.S. Application Data

(63) Continuation-in-part of application No. 08/805,488, filed on Feb. 25, 1997, now Pat. No. 6,123,413, which is a continuation-in-part of application No. 08/547,885, filed on Oct. 25, 1995.

(51) Int. Cl.[7] ..... B41J 2/14
(52) U.S. Cl. ..... 347/47
(58) Field of Search ..... 347/47, 20; 239/601

(56) References Cited

U.S. PATENT DOCUMENTS

| | | | | |
|---|---|---|---|---|
| 4,409,602 A | | 10/1983 | Bolmgren et al. | 347/68 |
| 4,502,060 A | | 2/1985 | Rankin et al. | 347/65 |
| 4,528,577 A | | 7/1985 | Cloutier et al. | 347/47 |
| 4,550,326 A | | 10/1985 | Allen et al. | 347/44 |
| 4,587,534 A | | 5/1986 | Saito et al. | 347/47 |
| 4,641,785 A | | 2/1987 | Grothe | 239/597 |
| 4,773,971 A | | 9/1988 | Lam et al. | 205/75 |
| 5,109,823 A | | 5/1992 | Yokoyama et al. | 123/472 |
| 5,167,776 A | | 12/1992 | Bhaskar et al. | 205/75 |
| 5,194,877 A | | 3/1993 | Lam et al. | 347/63 |
| 5,255,017 A | | 10/1993 | Lam | 347/67 |
| 5,443,713 A | | 8/1995 | Hindman | 205/70 |
| 5,560,837 A | | 10/1996 | Trueba | 216/27 |
| 6,123,413 A | * | 9/2000 | Agarwal et al. | 347/47 |

FOREIGN PATENT DOCUMENTS

| | | | | |
|---|---|---|---|---|
| EP | 337429 A2 | | 4/1989 | B41J/3/04 |
| EP | 419190 A2 | | 9/1990 | B41J/2/16 |
| EP | 577383 A2 | | 6/1993 | B41J/2/16 |
| EP | 792744 A2 | | 1/1997 | B41J/2/14 |
| JP | 61134262 | | 6/1986 | B41J/3/04 |
| JP | 361134262 A | * | 6/1986 | |

* cited by examiner

*Primary Examiner*—N. Le
*Assistant Examiner*—Shih-Wen Hsieh
(74) *Attorney, Agent, or Firm*—Raymond A. Jenski

(57) ABSTRACT

A printhead having reduced spray includes orifi from which ink is expelled by an ink ejector. The orifi employ an aperture at the outer surface of the orifice plate having an asymmetrical hourglass shape to cause the expelled ink drop to break off at the narrow end of the orifice aperture.

13 Claims, 9 Drawing Sheets

ASYMMETRIC INK EMITTING ORIFICES FOR IMPROVED INKJET DROP FORMATION

This patent is a continuation-in-part of U.S. patent application No. 08/805,488 "Reduced Spray Inkjet Printhead Orifice", filed on behalf of Agarwal, et al. on Feb. 25, 1997 now U.S. Pat. No. 6,123,413 which is a continuation-in-part of U.S. patent application No. 08/547,885, "Non-Circular Printhead Orifice", filed on behalf of Weber on Oct. 25, 1995 now still pending and assigned to the assignee of the present invention.

BACKGROUND OF THE INVENTION

The present invention is generally related to an inkjet printer printhead having an improved orifice design and is more particularly related to a printhead orifice design having an opening with characteristics producing reduced ink spray and improved trajectory error.

An inkjet printer forms characters and images on a medium, such as paper, by expelling droplets of ink in a controlled fashion so that the droplets land in desired locations on the medium. In its simplest form, such a printer can be conceptualized as a mechanism for moving and placing the medium in a position such that the ink droplets can be placed on the medium, a printing cartridge which controls the flow of ink and expels droplets of ink to the medium, and appropriate control hardware and software. A conventional print cartridge for an inkjet printer comprises an ink containment section, which stores and supplies ink as needed, and a printhead, which heats and expels the ink droplets as directed by the printer control software. Typically, the printhead is a laminate structure including a semiconductor base, a barrier material structure which is honeycombed with ink flow channels, and an orifice plate which is perforated with small holes or orifices arranged in a pattern which allows ink droplets to be expelled.

In one variety of inkjet printer the expulsion mechanism consists of a plurality of heater resistors formed in the semiconductor substrate which are each associated with one of a plurality of ink firing chambers formed in the barrier layer and one orifice of a plurality of orifi in the orifice plate. Each of the heater resistors is connected to the controlling software of the printer such that each of the resistors may be independently energized to quickly vaporize a portion of ink into a bubble which subsequently expels a droplet of ink from an orifice. Ink flows into the firing chamber formed in the barrier layer around each heater resistor and awaits energization of the heater resistor. Following ejection of the ink droplet and collapse of the ink bubble, ink refills the firing chamber to the point where a meniscus is formed across the orifice. The form and constrictions in barrier layer channels through which ink flows to refill the firing chamber establish both the speed at which ink refills the firing chamber and the dynamics of the ink meniscus. Further details of printer, print cartridge, and printhead construction may be found in the Hewlett-Packard Journal, Vol. 36, No. 5, May 1985, and in the Hewlett-Packard Journal, Vol. 45, No. 1, February 1994.

One of the problems faced by designers of print cartridges is that of maintaining a high print quality while achieving a high rate of printing speed. When a droplet is expelled from an orifice due to the rapid boiling of the ink inside the firing chamber, most of the mass of the ejected ink is concentrated in the droplet which is directed toward the medium. However, a small portion of the expelled ink resides in a tail extending from the droplet to the surface opening of the orifice. The velocity of the ink found in the tail is generally less than the velocity of the ink found in the droplet so that at some time during the trajectory of the droplet, much of the tail is severed from the droplet. Some of the ink in the severed tail rejoins the expelled droplet or remains as a distortion of the droplet to create rough edges on the printed material. Some of the expelled ink in the tail returns to the printhead, forming puddles on the surface of the orifice plate of the printhead. Some of the ink in the severed tail forms subdroplets ("spray") which travel and spread randomly in the general direction of the ink droplet. This spray often lands on the medium to produce a background of ink haze.

To reduce the detrimental results of spray, others have reduced the speed of the printing operation but have suffered a reduction in the number of pages which a printer can print in a given amount of time. The spray problem has also been addressed by optimizing the architecture or geometry of the ink firing chamber and the associated ink feed conduits in the barrier layer. Orifice geometries also affect spray, see U.S. patent application Ser. No. 08/608,923, "Asymmetric Printhead Orifice" filed on behalf of Weber et al. on Feb. 29, 1996 now still pending.

One conventional method of fabricating an orifice plate utilizes an electroless plating technique on a prefabricated mandrel. Such a mandrel is illustrated in FIG. 1 (which is not drawn to scale), in which a substrate 101 has at least one flat surface constructed of silicon or glass. Disposed on the flat surface of the substrate 101 is a conducting layer 103, generally a film of chromium or stainless steel. A vacuum deposition process, such as the planar magnetron process, may be used to deposit this conductive film 103. Another vacuum deposition process may be used to deposit a dielectric layer 105, which typically is silicon nitride, and is deposed by a vacuum deposition process such as a plasma enhanced chemical vapor deposition process. Dielectric layer 105 is desirably very thin, typically having a thickness of approximately 0.30 $\mu$m. Dielectric layer 105 is masked with a photoresist mask, exposed to UV light, and introduced into a plasma etching process which removes most of the dielectric layer except for "buttons" of dielectric material in preselected positions on the conductive layer 103. Of course, these positions are predetermined to be the location of each orifice of the orifice plate which is to be created atop the mandrel.

This reusable mandrel is placed into an electroforming bath in which the conducting layer 103 is established as a cathode while a base material, typically nickel, is established as the anode. During the electroforming process, nickel metal is transferred from the anode to the cathode and the nickel (shown as layer 107) attaches to the conductive areas of the conductive layer 103. Since the nickel metal plates uniformly from each conductive plate of the mandrel, once the surface of the dielectric button 105 is reached, the nickel overplates the dielectric layer in a uniform and predictable pattern. The parameters of the plating process, including the time of plating, are carefully controlled so that the opening of the nickel layer 107 formed over the dielectric layer button 105 is a predetermined diameter (typically about 45 $\mu$m) at the dielectric surface. This diameter is usually one third to one fifth the diameter of the dielectric layer button 105 thereby resulting in the top layer of the nickel 107 having an opening at the inner surface of the orifice plate of diameter d2 which is approximately three to five times the diameter of d1 of the opening which will be the orifice aperture at the external surface of the orifice plate. At the completion of the electroless plating process, the newly formed orifice plate is removed from the mandrel and gold plated for corrosion resistance of the orifice. Additional description of metal orifice plate fabrication may be found in U.S. Pat. Nos. 4,773,971; 5,167,776; 5,443,713; and 5,560,837, each assigned to the assignee of the present invention.

Improperly directed ink drops and satellite droplets and spray undesirably result in a poorer quality of character and image formation on an inkjet printed medium. It is desirable that random trajectory due to drops issuing randomly from sides of the ejecting orifice be reduced and that spray due to drop tail break-off be diminished.

SUMMARY OF THE INVENTION

The present invention encompasses a printhead for an inkjet printer which utilizes an ink ejector to expel ink from orifi in an orifice plate. The orifice plate has at least one orifice extending through the orifice plate from a first surface of the orifice plate opposite the ink ejector to a second surface of the orifice plate essentially parallel the first surface. The orifice includes an aperture at the second surface, the aperture comprised of at least two intersecting edges defining a periphery of the aperture. A first edge comprises a first arc segment having a first radius and a first center disposed within the periphery of the aperture. A second edge comprising a second arc segment having a second radius and a second center disposed outside the periphery of the aperture.

DETAILED DESCRIPTION OF A PREFERRED EMBODIMENT

Random drop trajectory and excess spray are reduced when employing the present invention as a result of an asymmetric orifice aperture, in which trajectory can be biased to occur in one direction from the ejecting orifice.

Figure 2:
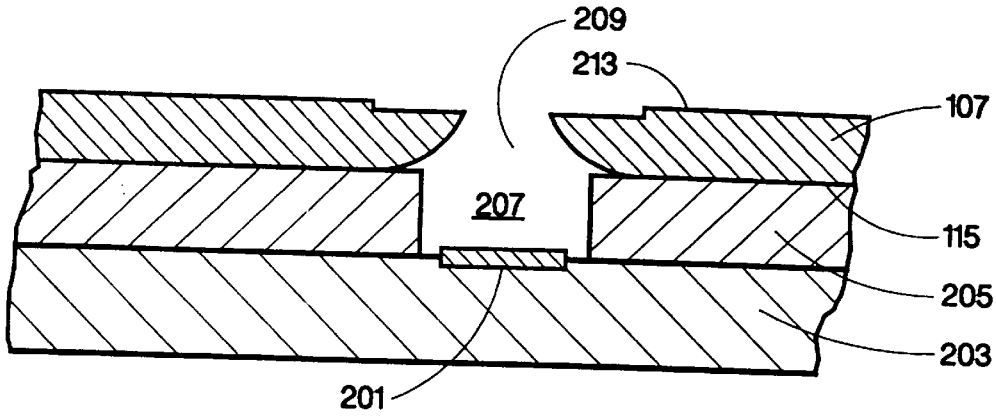
FIG. 2 is a cross sectional view of a conventional printhead showing one ink firing chamber.

A cross section of a conventional printhead is shown in FIG. 2. A thin film resistor 201 is created at the surface of a semiconductor substrate 203 and typically is connected to electrical inputs by way of a metalization (not shown) on the surface of the semiconductor substrate 203. Additionally, various layers offering protection from chemical and mechanical attack may be placed over the heater resistor 201, but are not shown in FIG. 2 for clarity. A layer of barrier material 205 is selectively placed on the surface of the silicon substrate 203 (or layers thereon) thereby leaving an opening or ink firing chamber 207 around the heater resistor 201 so that ink may accumulate in the firing chamber prior to activation of heater resistor 201 and ejection of ink through an orifice 209. The barrier material for barrier layer 205 is conventionally Parad® available from E. I. DuPont De Nemours and Company or equivalent material. The orifice 209 is a hole in the orifice plate 107 extending from the inside surface of the orifice plate to the external surface of the orifice plate and which can be formed as part of the orifice plate as previously described.

Figure 3:
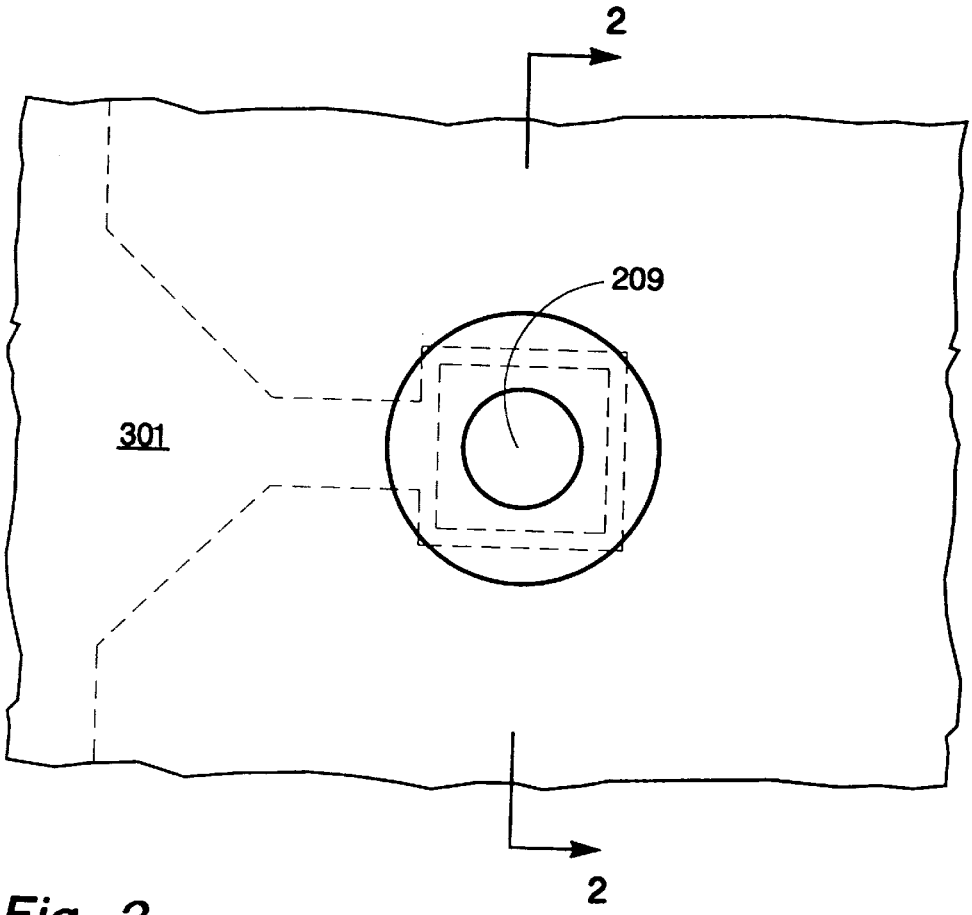
FIG. 3 is a plan view of the outer surface of the orifice plate of a conventional printhead.
Figure 4:
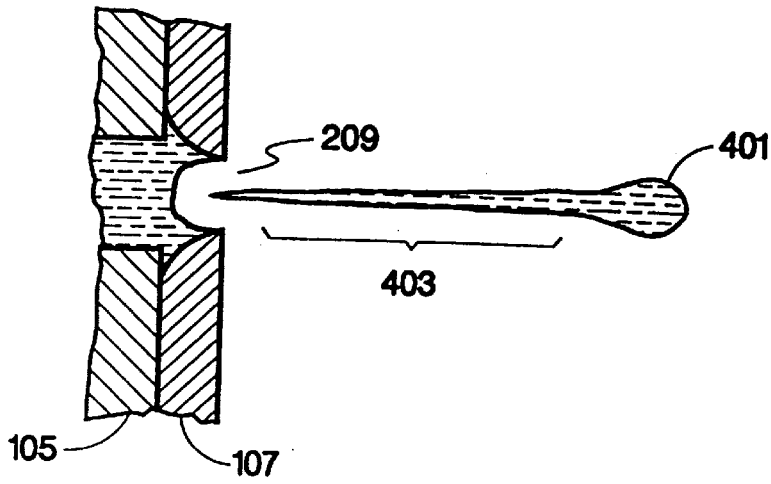
FIG. 4 is a cross sectional view of a conventional printhead illustrating the expulsion of an ink droplet.

FIG. 3 is a top plan view of a conventional printhead (indicating the section A—A of FIG. 2), viewing orifice 209 from the external surface 213 of the orifice plate 107. An ink feed channel 301 is present in the barrier layer 205 to deliver ink to the ink firing chamber from a larger ink source (not shown). FIG. 4 illustrates the configuration of ink in an ink droplet 401 at a time 22 microseconds after the ink has been expelled from the orifice 209. In conventional orifice plates, (in which circular orifice apertures are used) the ink droplet 401 maintains a long tail 403 which can be seen to extend back to at least the orifice 209 in the orifice plate 107.

After the droplet 401 leaves the orifice plate and the bubble of vaporized ink which expelled the droplet collapses, capillary forces draw ink from the ink source through the ink feed channel 301. In an underdamped system, ink rushes back into the firing chamber so rapidly that it overfills the firing chamber 207, thereby creating a bulging meniscus. The meniscus then oscillates about its equilibrium position for several cycles before settling down. Extra ink in the bulging meniscus adds to the volume of an ink droplet should a droplet be expelled while the meniscus is bulging. A retracted meniscus reduces the volume of the droplet should the droplet be expelled during this part of the cycle. Printhead designers have improved and optimized the damping of the ink refill and meniscus system by increasing the fluid resistance of the ink refill channel. Typically this improvement has been accomplished by lengthening the ink refill channel, decreasing the ink refill channel cross section, or by increasing the viscosity of the ink. Such an increase in ink refill fluid resistance often results in slower refill times and a reduced rate of droplet ejection and printing speed.

Figure 5:
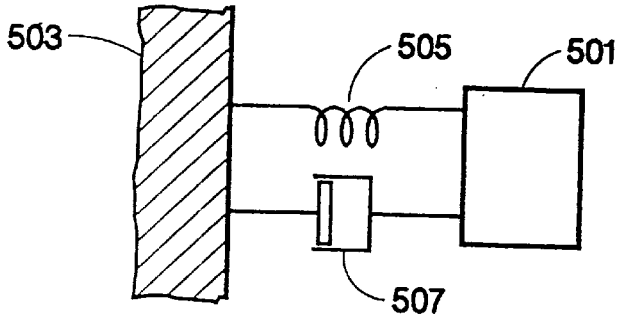
FIG. 5 is a theoretical model of the droplet-meniscus system which may be useful in understanding the performance of the present invention.

A simplified analysis of the meniscus system is one such as the mechanical model shown in FIG. 5, in which a mass 501, equivalent to the mass of the expelled droplet, is coupled to a fixed structure 503 by a spring 505 having a spring constant, K, proportional to the reciprocal of the effective radius of the orifice. The mass 501 is also coupled to the fixed structure 503 by a damping function 507 which is related to the channel fluid resistance and other ink channel characteristics. In the present configuration, the drop weight mass 501 is proportional to the diameter of the orifice. Thus, if one desires to control the characteristics and performance of the meniscus, one may adjust the damping factor of the damping function 507 by optimizing the ink channel or adjusting the spring constant of spring 505 in the mechanical model.

Figure 6:
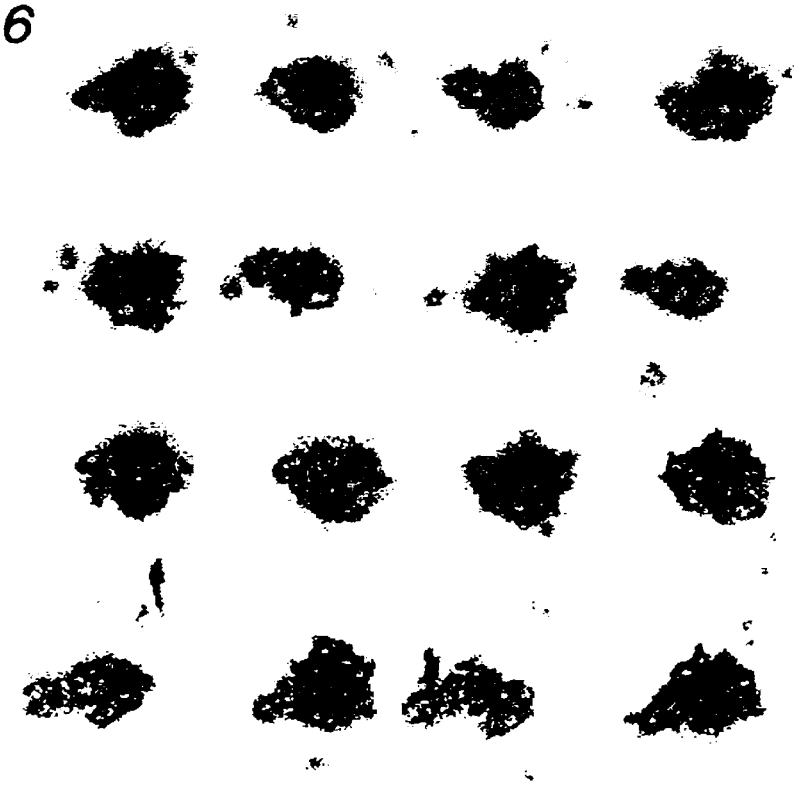
FIG. 6 is a reproduction of the detrimental effects of spray and elongated droplet tail upon a printed medium.

When the droplet 401 is ejected from the orifice most of the mass of the droplet is contained in the leading head of the droplet 401 and the greatest velocity is found in this mass. The remaining tail 403 contains a minority of the mass of ink and has a distribution of velocity ranging from nearly the same as the ink droplet head at a location near the ink droplet head to a velocity less than the velocity of the ink found in the ink droplet head and located closest to the orifice aperture. At some time during the transit of the droplet, the ink in the tail is stretched to a point where the tail is broken off from the droplet. A portion of the ink remaining in the tail is pulled back to the printhead orifice plate 107 where it typically forms puddles of ink surrounding the orifice. These ink puddles degrade the quality of the printed material by causing misdirection of subsequent ink droplets. Other parts of the ink droplet tail are absorbed into the ink droplet head prior to the ink droplet being deposited upon the medium. Finally, some of the ink found in the ink droplet tail neither returns to the printhead nor remains with or is absorbed in the ink droplet, but produces a fine spray of subdroplets spreading in a random direction. Some of this spray reaches the medium upon which printing is occurring thereby producing rough edges to the dots formed by the ink droplet and placing undesired spots on the medium which reduces the clarity of the desired printed material. Such an undesired result is shown in the magnified representation of printed dots in FIG. 6.

It has been determined that the exit area of the orifice aperture 209 to the external environment defines the drop weight of the ink droplet expelled. It has further been determined that the restoring force of the meniscus (constant K in the model) is determined in part by the proximity of the edges of the orifice aperture. Thus, to increase the stiffness of the meniscus, the sides and opening of the orifice bore hole should be made as close together as possible. This, of course, is in contradiction to the need to maintain a given drop weight for the droplet (which is determined by the exit area of the orifice). A greater restoring force on the meniscus provided by the non-circular geometry causes the tail of the ink droplet to be broken off sooner and closer to the orifice plate thereby resulting in a shorter ink droplet tail and significantly reduced spray.

Some non-circular orifices which may be utilized to reduce spray are elongated apertures having a major axis and a minor axis, in which the major axis is of a greater dimension than the minor axis and both axes are parallel to the outer surface of the orifice plate. Such elongate structures can be rectangles and parallelograms or ovals such as ellipses and parallel-sided "racetrack" structures. Using the ink contained in a model number HP51649A print cartridge (available from Hewlett-Packard Company) and orifice aperture areas equal to the area of the orifice aperture area used in the HP51649A cartridge, it was determined that ellipses having major axis to minor axis ratios of from 2 to 1 through 5 to 1 demonstrated the desired meniscus stiffening and short tail ink droplet ejection.

Figure 7A:
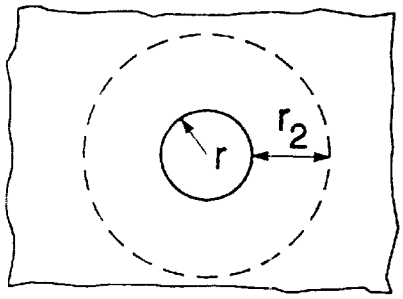
FIGS. 7A and 7B are plan views from the external surface of the orifice plate showing orifice surface apertures.
Figure 7B:
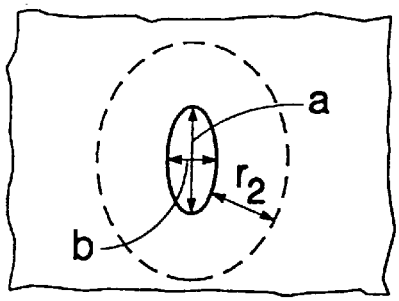

FIGS. 7A–7B are plan views of the orifice plate external surface illustrating the various types of orifice bore hole dimensions. FIG. 7A illustrates a circular orifice having a radius r at the outer dimension and a difference in radius between the outer demension r and the opening to the firing chamber of value $r_2$. In the HP51649A cartridge, r=17.5 microns and $r_2$=45 microns. This yields an aperture area at the orifice plate outer surface ($r^2 \times \pi$) of 962 microns$^2$. FIG. 7B illustrates an ellipsoidal external orifice aperture geometry in which the major axis/minor axis ratio equals 2 to 1 and, in order to maintain an equal droplet drop weight, the outer area of the orifice opening is maintained at 962 microns$^2$. Thus, from the formula for the area of the ellipse ($A-\pi \cdot a \cdot b$), the major and minor axes (a, b) of the ellipse are respectively 28.5 microns and 12.4 microns for the 2:1 ellipse.

As suggested above, the major contributing factor to the better tail break-off and subsequent spray reduction is the reduction of the size of the minor axis of the ellipse. Within the range of axis ratios of 2:1 to approximately 5:1, reduction of spray is observed. One drawback, which was also noted above, is that elliptic orifi surface openings have a corresponding larger opening at the interior surface of the orifice plate (at the ink firing chamber). These interior openings will overlap and interfere when the orifi are spaced closely together for improved print resolution. This interference takes the form of ink from one firing chamber being blown into an adjacent firing chamber and other subtle but detrimental effects.

In order to resolve the interference problem, the ellipse has been distorted in the major axis direction, to create, in essence, a crescent or quarter moon shape. The minor axis dimension is preserved and the effective major axis is shortened with this crescent shape while the overall orifice aperture area remains constant. Appropriate spray reduction continues to be achieved using a crescent orifice opening shape. The crescent shape, however, introduces a different problem into the quality of print realized with this form of printhead. The trajectory of the ink droplets leaving the orifice plate is not perpendicular to the orifice plate surface but is tilted away from perpendicularity toward the direction of the negative radius of curvature surface of the orifice aperture.

Figure 8A:
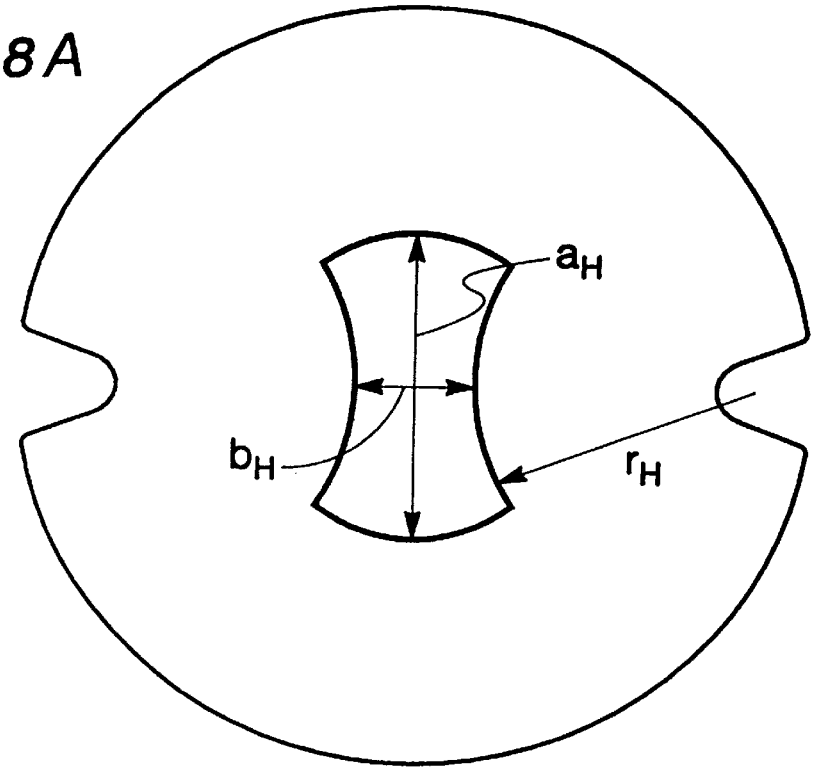
FIGS. 8A and 8B are plan views from a surface of the orifice plate showing an orifice surface aperture which may be employed in the present invention.
Figure 9A:
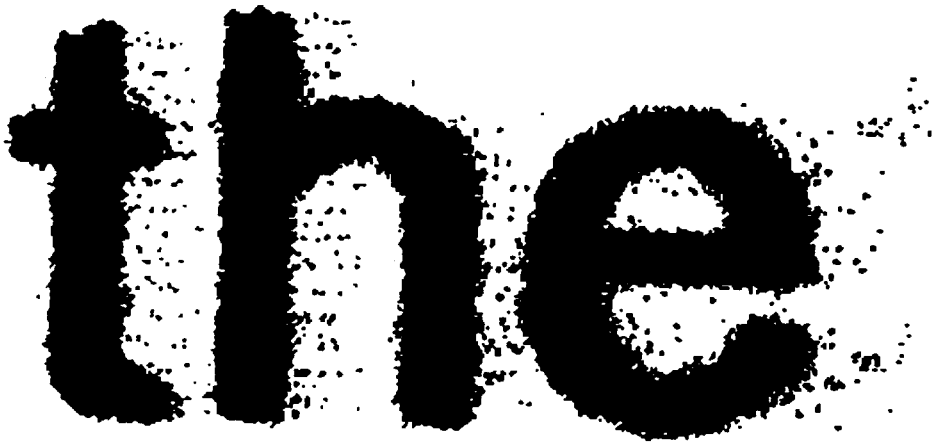
FIGS. 9A and 9B are reproductions of spray effects upon a printed medium and the improvement of offered by the present invention.
Figure 9B:
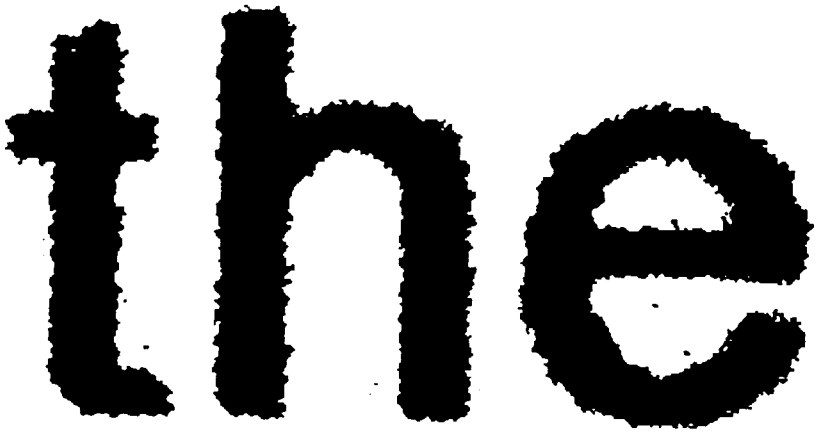

To resolve the trajectory problem of the crescent orifice aperture shape, another shape which provides symmetry is created by overlaying two crescent shapes with the limbs of the crescent facing away from each other. Such a shape is illustrated in FIG. 8A. This modified orifice aperture shape has been deemed a "hourglass" shape. The modified minor axis ($b_H$), in one implementation, has been set at 26 $\mu$m while the modified major axis ($a_H$) has been established at 69 $\mu$m. The edges which define the modified minor axis for this implementation have a radius of curvature ($r_H$) of approximately 47 $\mu$m. This orifice aperture shape preserves the narrow minor axis opening while reducing the necessary major axis dimension required for the fixed orifice aperture area. The reduced dimension major axis allows closer spacing of the orifi than could otherwise be realized with an ellipse of the same orifice aperture area. Further, the hourglass orifice aperture shape provides a symmetry about both major and minor axes and reduces the problem of trajectory error of an ink droplet. The improvement afforded by a non-circular orifice aperture over a conventional circular opening can be appreciated by comparing FIG. 9B with FIG. 9A. The highly magnified letters of FIG. 9B show very few of the extraneous droplets which are seen in the print of FIG. 9A.

Figure 8B:
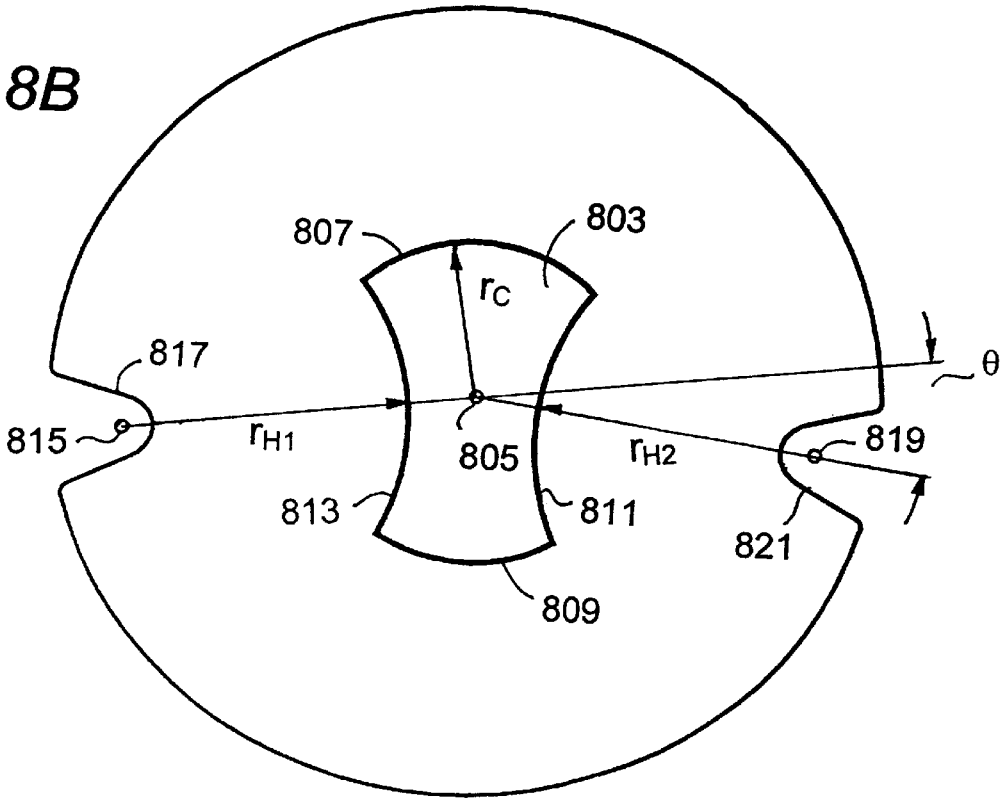

Referring now to FIG. 8B, and to obtain an even greater trajectory error reduction, a reliable point of tail break-off is established in an hourglass shape having the orifice aperture asymmetrical with respect to the modified minor axis. The asymmetric hourglass orifice aperture is shown as orifice aperture 803 in FIG. 8B. The orifice aperture 803 hourglass shape comprises the edges of the orifice aperture at thee outer surface of the orifice plate. In a preferred embodiment, the peripheral shape of the orifice aperture is formed by two arc segments having a common center point of radius 805 and a common radius magnitude, $r_e$, but the first arc segment 807 being larger than the second arc segment 809 (disposed opposite the first arc segment). The orifice aperture 803 hourglass shape aperture periphery also comprises two arc segments 811 and 813 joining the adjacent end points of arc segments 807 and 809 to complete the periphery of the orifice aperture 803. The arc segment 813 has a radius magnitude, $r_{H1}$, and a center point of radius 815 that is located outside of the hourglass periphery but disposed within a protrusion 817 in the orifice aperture formed at the other, inner, surface of the orifice plate adjacent the ink ejector. The arc segment 811 also has a radius magnitude $r_{H2}$, and a center point of radius 819 within another protrusion 821 at the inner surface orifice aperture. It is a feature of the present invention that the center 815 is disposed nearly on the opposite side of the orifice from the center 819 but not exactly opposite. In a preferred embodiment, a line drawn joining the center 805 with the center 815 intersects a line drawn joining the center 805 with the center 819 and forms an acute angle θ. The acute angle θ formed between the two lines is adjusted to be in the range of 0° to 20° and preferably is approximately 5°. Thus, the orifice aperture 803 formed by electroplating at the outer orifice plate surface has an asymmetric hourglass orifice aperture and has an orifice aperture at the inner orifice plate surface comprised of two long arc segments having a common center and separated by the two protrusions. The ink drop tail preferentially breaks off from the narrower end (that is, at shorter arc segment 809) and provides a reliable location of tail break-off and spray. Uniform trajectory is achieved for drops ejected from each orifice employing the asymmetric hourglass shape.

Figure 1:
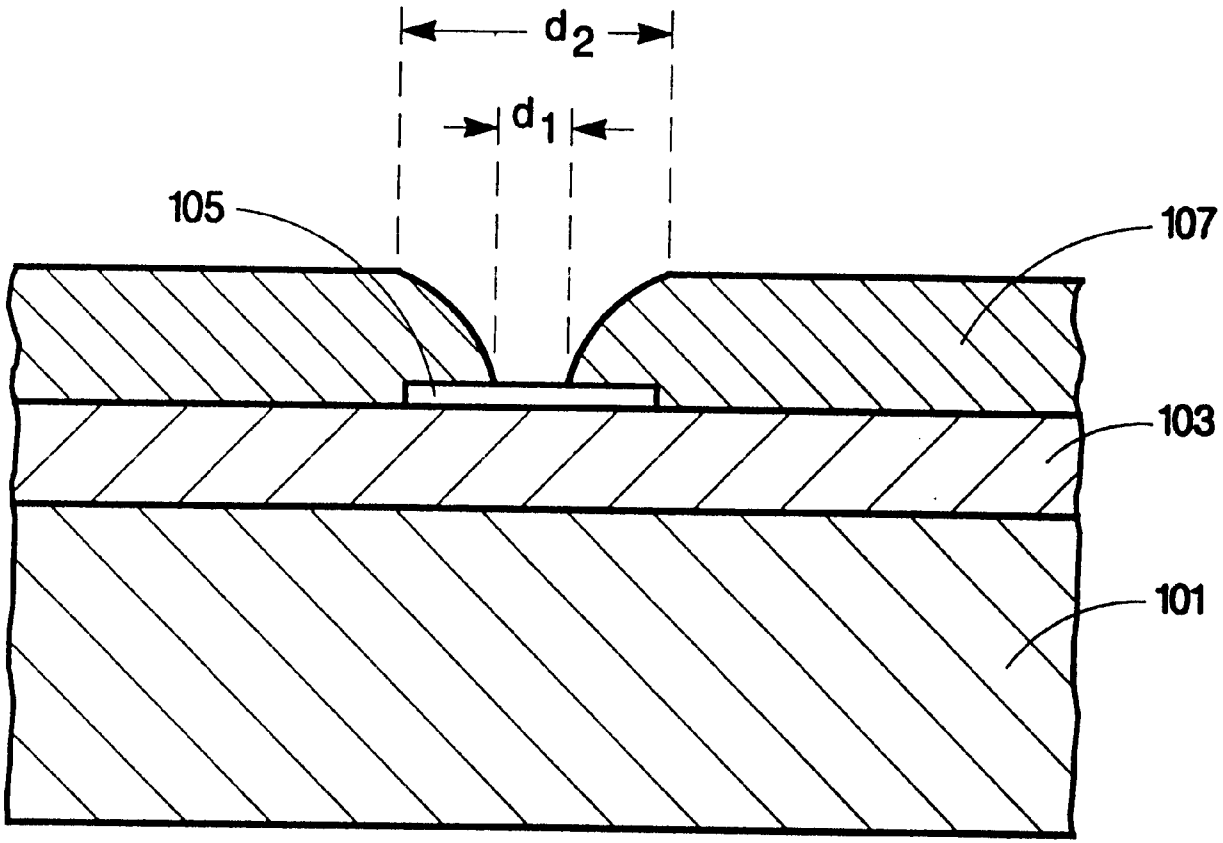
FIG. 1 is a cross section of an orifice plate forming mandrel and an orifice plate formed on the mandrel.

As previously described, the orifice plate is conventionally formed by electroplating nickel or similar metal on a mandrel and then plating the orifice plate with chemically resistant materials such as gold. Previously, it has been known to utilize a non-conductive button in the shape of the desired end result: the circular orifice aperture. In order to create an hourglass-shaped orifice opening, however, it was determined that a button having a shape much less complicated than an hourglass shape could be used. Since during electroplating the orifice plate base metal grows uniformly in each available direction from a conducting surface (including its own surface) details in the non-conducting button shape would be obscured by the growing base metal. Likewise, a detail in the button shape can be transformed into an entirely different shape as the base metal grows. Consider, again, FIG. 1 in which the base metal 107 grows over the top surface of the non-conducting insulating button 105. When viewed in the plan view, a detail in the outline of the button 107 can be obscured or transformed into other shapes as the base metal 107 grows over the insulating button 105 top surface.

Figure 10:
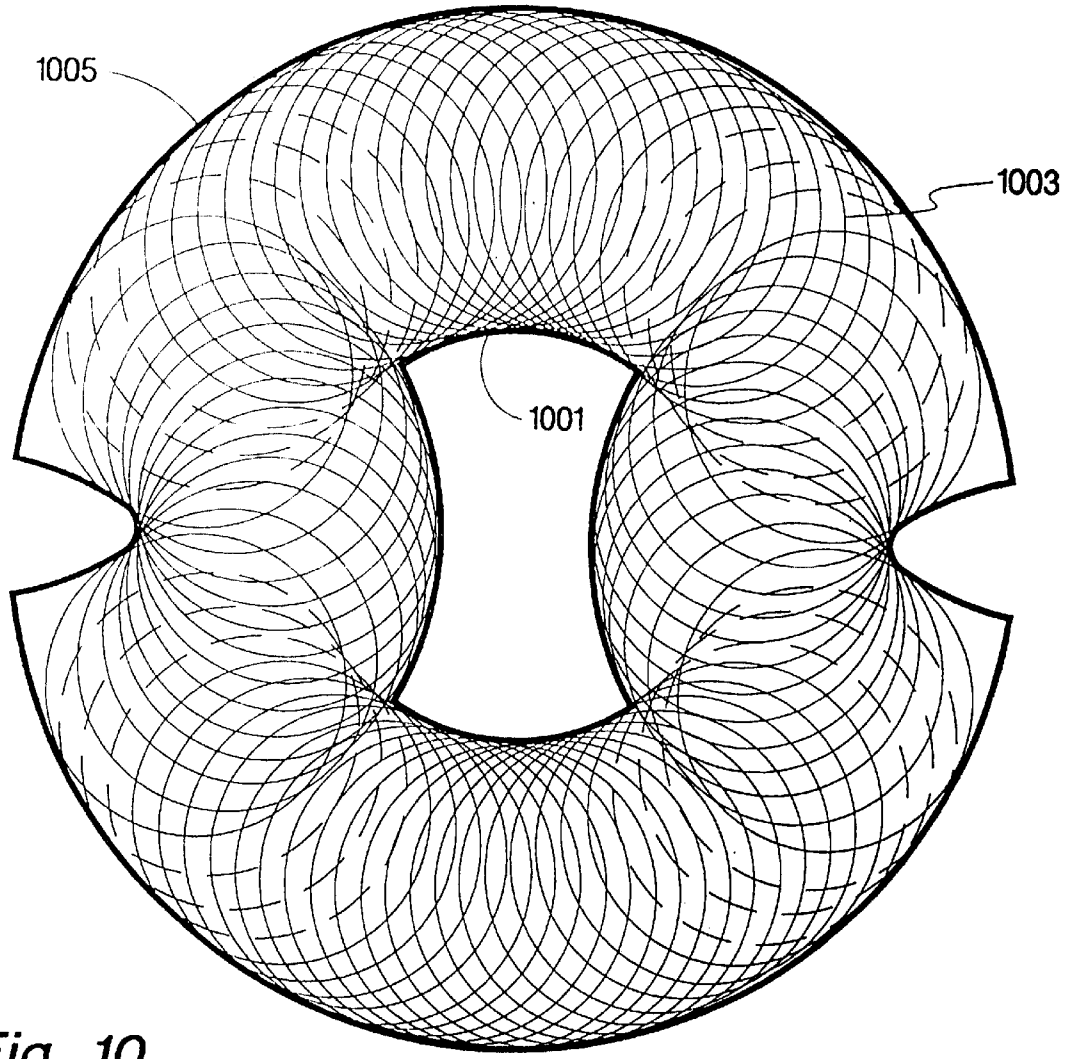
FIG. 10 illustrates a technique of forming an orifice aperture which may be employed in the present invention.

It has been found that an analysis technique utilizing a family of circles having a diameter equal to the desired base metal growth can be placed in the same plane and tangential to the outside outline of the desired orifice shape. When the point on the circumference of the circle opposite the point of tangency and sharing the same diameter line is joined to each other similar point of the family of circles, the shape the non-conducting button must take is revealed. An alternative procedure uses arcs of radii drawn from all or a representative number of points on the outside outline of the starting shape. The end point of the radius of each arc (perpendicular to a line drawn tangent to the point of the starting outline) defines a point on the orifice shape which results after the plating process is complete. Reference to FIG. 10 will aid in visualizing the technique using the family of circles.

In FIG. 10, the hourglass shape of the orifice aperture is identified as 1001. A family of circles having a radius equal to the desired growth of base metal is represented by circle 1003. The outline of the non-conductive button is shown as 1005. Each circle of the family of circles is made tangent to the hourglass orifice shape at a point along the edge of the hourglass shape. Taking the point directly across the diameter of each circle and joining those points yields the shape of the non-conducting button. When dealing with more complex orifice shapes, it has been found that the shape of the non-conducting button does not have to be identical to the shape of the orifice. Observe that at the limbs of the hourglass shape 1001, the number of circles needed to define the shape diminishes.

Figure 11:
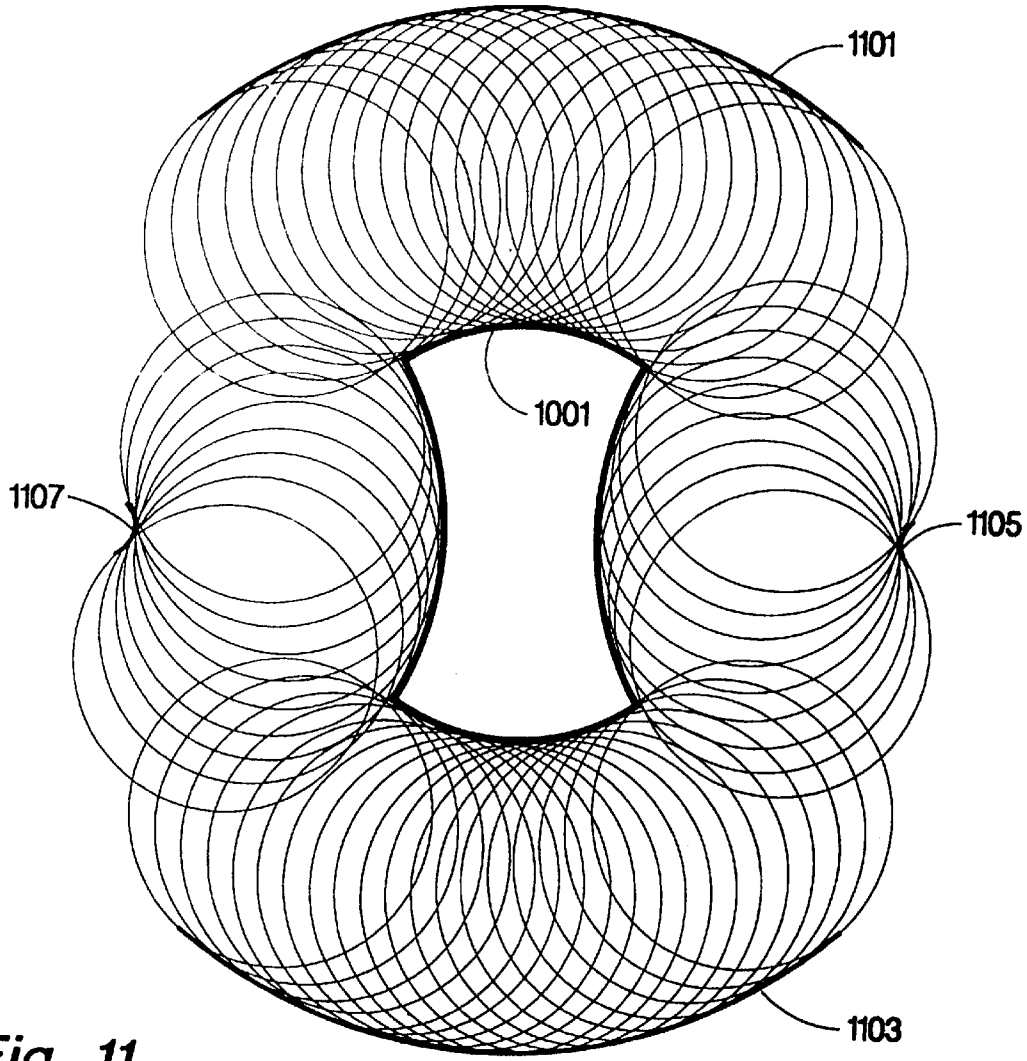
FIG. 11 illustrates a technique of forming an orifice aperture which may be employed in the present invention.

FIG. 11 illustrates the necessary construction circles needed to create the orifice opening 1001. Joining the points on the circumference opposite the point of tangency yields the minimum button outline needed to produce the hourglass orifice opening desired. These outline configurations include arc 1101 and arc 1103 to produce the edges forming the terminals of the major axis and parabolic portions 1105 and 1107 to produce the edges forming the terminals of the minor axes. As long as the remainder of the button outline does not come closer to the desired orifice shape than a circle diameter, the hourglass orifice shape produced by electroplating an orifice plate will be independent of the button outline other than the identified arcs and parabolic sections.

Figure 12:
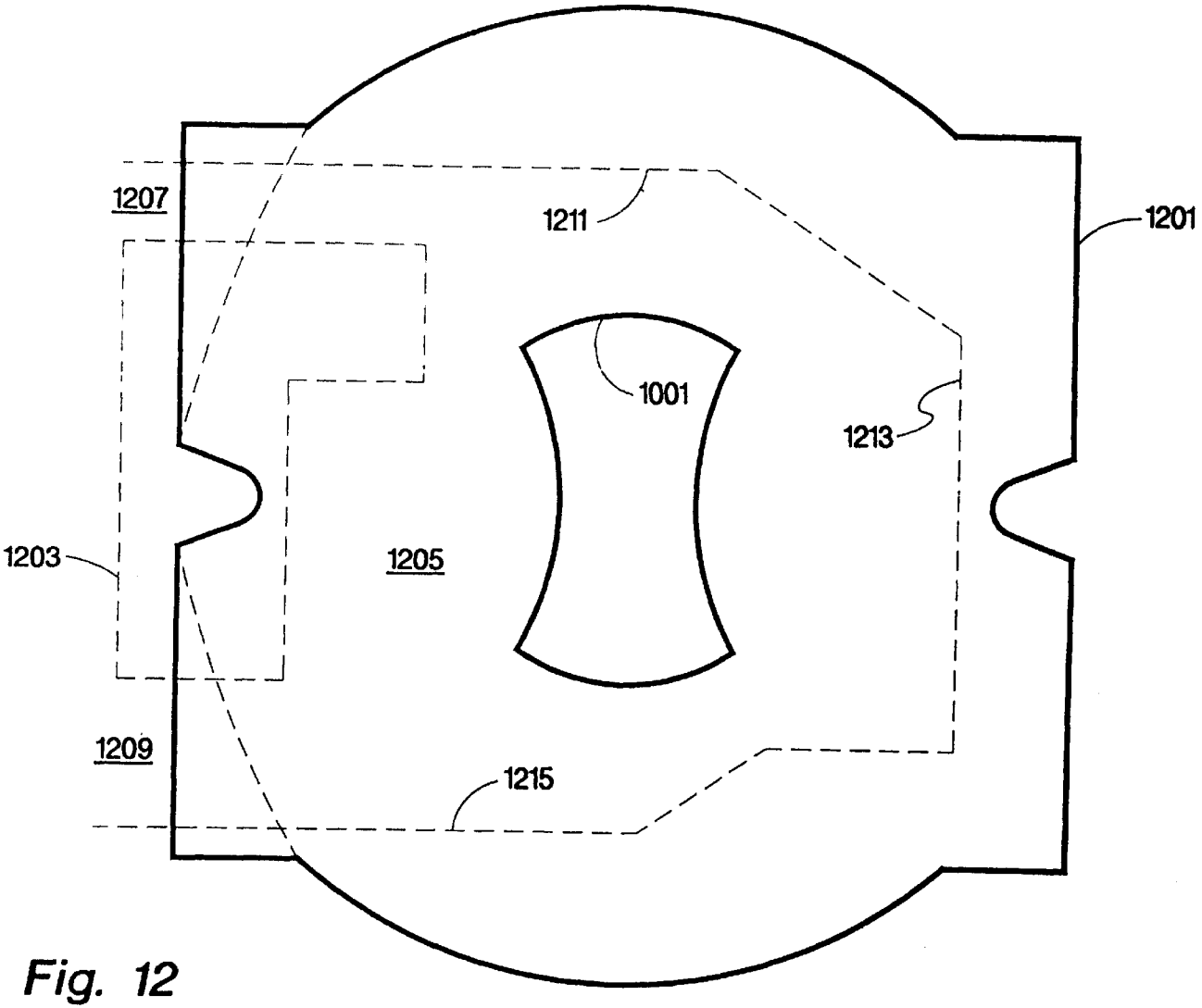
FIG. 12 is a plan view from the external surface of the orifice plate illustrating the orifice surface aperture and orifice bore in relation to an ink firing chamber, as may be employed in the present invention.

This outline independence is used in an embodiment of the invention to provide improved adhesion of the orifice plate to the barrier material and allows the firing chamber to be designed with a larger volume of ink. FIG. 12 illustrates the printhead which is obtained when the non-conducting mandrel button shape is partially independent of the orifice surface hole shape. The orifice aperture 1001 and the button shape 1201 are shown in solid line for the sake of clarity although the orifice hole 1101 is located on the external surface of the orifice plate and the button shape is located on the inner surface of the orifice plate. The bore of the orifice changes from the button shape 1201 to the hourglass shaped aperture 1001 as one views the orifice bore starting at the ink firing chamber and traverses to the opening at the surface of the orifice plate. In this embodiment, the configuration of the barrier layer material is shown in broken line. An island of barrier material 1203 divides the ink inlet to the firing chamber 1205 into two ink channels 1207 and 1209 and the remainder of the firing chamber 1205 is defined by walls of barrier material 1211, 1213, 1215, etc. Improved areas of contact between the barrier layer material and the orifice plate are realized in the zone around the barrier island 1203 (and illustrated with further broken line representing the hypothetical circular button outline). This improved contact area is a result of the squaring of the button shape in portions which would otherwise be circular to better match the square implementation of the barrier material and provides a rectangular cross section at the substrate which does not vary even when a misalignment of the orifice plate occurs. Further, the square implementation provides increased ink volume in the firing chamber.

Thus, the present invention utilizes an orifice aperture shape that is an asymmetric hourglass shape that produces ejected ink drops having reduced spray and improved ink drop trajectory.

We claim:

1. A printhead for an inkjet printer including orifi from which ink is expelled, comprising:

an ink ejector; and an orifice plate having an orifice extending through said orifice plate from a first surface of said orifice plate opposite said ink ejector to a second surface of said orifice plate essentially parallel to said first surface, said orifice including an aperture at said second surface, said aperture in said second surface of said orifice comprised of at least two intersecting edges defining a periphery of said aperture, a first edge comprising a first arc segment having a first radius and a first center disposed within said periphery of said aperture, and a second edge comprising a second arc segment having a second radius and a second center disposed outside said periphery of said aperture, and a third edge comprising a third arc segment having a third radius and a third center disposed outside said periphery of said aperture and spaced apart from said second center.

2. A printhead in accordance with claim 1 further comprising a fourth edge comprising a fourth arc segment having a fourth radius and said first center.

3. A printhead in accordance with claim 2 wherein said fourth radius equals said first radius.

4. A printhead in accordance with claim 2 wherein said first arc segment is larger than said second arc segment.

5. A printhead in accordance with claim 1 wherein said first line joining said first center and said second center forms an acute angle with a second line joining said first center with said third center, said acute angle having a value ranging between 0° and 20°.

6. A print cartridge comprising the printhead of claim 1.

7. A method of operation of a printhead for an inkjet printer which employs orifi from which ink is expelled, comprising the steps of:

imparting a velocity to a mass of ink; and expelling said mass of ink from an orifice that includes an aperture at a surface of an orifice plate, said aperture in said surface comprised of at least two intersecting edges defining a periphery of said aperture, a first edge comprising a first arc segment having a first radius and a first center disposed within said periphery of said aperture, a second edge comprising a second arc segment having a second radius and a second center disposed outside said periphery of said aperture, and a third edge comprising a third arc segment having a third radius and a third center disposed outside said periphery of said aperture and spaced apart from said second center.

8. A method of manufacturing a printhead for an inkjet printer comprising the steps of:

forming an orifice plate with a first surface and a second surface essentially parallel to said first surface and at least one orifice extending through said orifice plate from said first surface to a second surface, said orifice including an aperture at said second surface comprised of at least two intersecting edges defining a periphery of said aperture, a first edge comprising a first arc segment having a first radius and a first center disposed within said periphery of said aperture, a second edge comprising a second arc segment having a second radius and a second center disposed outside said periphery of said aperture, and a third arc segment formed with a third radius and a third center disposed outside said periphery of said aperture and spaced apart from said second center; and attaching an ink ejector to said first surface of said orifice plate whereby ink is ejected from said aperture of said at least one orifice.

9. A method in accordance with the method of claim 8 wherein said step of forming an orifice plate further comprises the step of including a fourth edge in said aperture periphery formed with a fourth arc segment having a fourth radius and said first center.

10. A method in accordance with the method of claim 9 wherein said step of forming an orifice plate further comprises the step of forming said fourth radius equal to said first radius.

11. A method in accordance with the method of claim 9 wherein said step of forming an orifice plate further comprises the step of forming said first arc segment larger than said second arc segment.

12. A method in accordance with the method of claim 8 wherein said step of forming first, second, third, and fourth arc segments further comprises the step of disposing said first, second, and third centers such that a first line joining said first center and said second center forms an acute angle with a second line joining said first center with said third center, said acute angle having a value ranging between 0° and 20°.

13. A method of manufacturing a printhead in accordance with the method of claim 8 further comprising the step of coupling said printhead to an ink source.

* * * * *